United States Patent [19]

Stern et al.

[11] 4,038,295

[45] July 26, 1977

[54] PROCESS FOR THE SELECTIVE HYDROGENATION OF POLYUNSATURATED OILS

[75] Inventors: Robert Stern, Paris; Eugène Ucciani, Marseille; André Hirschauer, Montesson; Georges Cecchi, Marseille, all of France

[73] Assignee: Institut Francais du Petrole et Institut des Corps Gras (ITERG), Rueil-Malmaison, France

[21] Appl. No.: 545,189

[22] Filed: Jan. 29, 1975

[30] Foreign Application Priority Data

Feb. 1, 1974 France ..... 74.03365

[51] Int. Cl.[2] ..... C11C 3/12

[52] U.S. Cl. ..... 260/409; 426/607; 426/608

[58] Field of Search ..... 260/409; 426/607, 608

[56] References Cited

U.S. PATENT DOCUMENTS

| | | | |
|---|---|---|---|
| 2,156,217 | 4/1939 | Andrews | 260/409 X |
| 2,566,362 | 9/1951 | Paterson | 260/409 |
| 3,117,939 | 1/1964 | Royce | 260/409 X |
| 3,197,418 | 7/1965 | Maebashi | 260/409 X |
| 3,205,278 | 9/1965 | Lapporte | 208/263 X |
| 3,240,698 | 3/1966 | Leak | 260/409 X |
| 3,278,568 | 10/1966 | de Jonge | 260/409 |
| 3,743,662 | 7/1973 | Eurlings et al. | 260/409 |

*Primary Examiner*—Winston A. Douglas
*Assistant Examiner*—John F. Niebling
*Attorney, Agent, or Firm*—Millen & White

[57] ABSTRACT

Highly unsaturated oils of vegetable or animal origin are selectively hydrogenated to less highly unsaturated oils using a catalytic composition obtained by dissolving a compound of a metal selected from the IB, IV B to VII B or VIII groups in an unsaturated oil and then adding thereto an organic derivative or hydride of a metal from groups I A, II A, II B or III A, in the absence of a stabilizing solvent.

24 Claims, No Drawings

PROCESS FOR THE SELECTIVE HYDROGENATION OF POLYUNSATURATED OILS

This invention concerns a process for selectively hydrogenating polyunsaturated oils of vegetable or animal origin.

The hydrogenation of polyunsaturated oils is of major industrial importance. It permits, for example, stabilization of such oils as, for example, soyabean, rapeseed, linseed or fish oil, which contain linolenic acid or higher polyenic acids in combined form. The hydrogenation must be selective, i.e., the polyenic acids must preferentially be transformed to monoenic acids while avoiding the hydrogenation of monoenic acids, so that the proportion of saturated acids does not substantially increase.

The hydrogenation process is applicable both to completely or partially refined oils and to crude oils.

Crude oils contain, besides glycerides, minor constituents including phosphatides, free fatty acids, sterols, carotenoids and various impurities which may poison conventional heterogeneous catalysts.

We have surprisingly found that crude oils could be hydrogenated according to the invention, as well as completely or partially refined oils.

The amount of catalytic metal with respect to the substrate is lower than or equal to 0.1% by weight (metal/oil) and may be as low as 0.001% by weight, which is a remarkable advantage of the invention.

It has been already proposed (French Pat. No. 1,390,570) to hydrogenate vegetable oils, fish oils or the like by catalysts consisting of a transition metal salt and an organo aluminum compound, but it was considered essential to prepare the catalyst by admixing a transition metal salt with an organo-aluminum compound in an inert solvent, for example, a hydrocarbon, before contacting it with a compound containing oxygen atoms, such as an ester.

This technique has two disadvantages : hydrocarbons unsuitable for human food are introduced into the oil and the resulting catalyst has a poor selectivity.

It has also been proposed to dissolve the transition metal compound in a complexing solvent such as toluene or tetrahydrofuran and to add the organoaluminum compound thereto. The solvent was considered necessary to confer selectivity since it provided a weakly coordinated bond with the transition metal and stabilized the latter. Here again, solvents unsuitable in human food are introduced and must be separated later.

In practice no example of direct hydrogenation of triglycerides with catalysts of this type is given in the literature.

The closest examples of hydrogenations of this type concern the hydrogenation of the methyl esters of cottonseed and soyabean oil or cyclopentadiene. However, these hydrogenations are conducted with purified or pure substrates which differ markedly from vegetable or animal oils. Also, the amount of catalyst is 10 to 100 times higher and the hydrogenation is selective only if toxic solvents or excess alkylaluminum are present, that is, the molar ratio of the alkylaluminum compound to the metal compound is about 10:1 to 20:1.

More broadly stated, the catalyst of the invention is obtained according to the following scheme : one part by mole of at least one salt or other compound of a metal from groups I B, IV B, V B, VI B, VII B and/or VIII, is dissolved in a polyunsaturated oil and 0.1 to 6 parts by mole of at least one organo metalic reducing agent is added thereto, in the absence of any solvent having a stabilizing action, i.e., in the absence of such solvents as aromatic hydrocarbons and ethers. The manufacture of the catalyst is carried out in an inert atmosphere or preferably in a hydrogen atmosphere. The periodic classification referred to is that of FISHER (Handbook of Chemistry and Physics by Hodgman, 1959, pages 448–449). Compounds of metals of other groups than those stated above may be used as cocatalysts, for example, aluminum, calcium or zinc compounds.

Among the transition metals which may be present in the above salts or compounds are iron, cobalt, nickel, palladium, copper, silver, gold, titanium, zirconium, vanadium, chromium, manganese, molybdenum and tungsten. Some of them may be associated, for example in pairs, as the following : nickel-copper, nickel-silver, nickel-chromium or chromium-copper.

Salts or compounds of the above metals include alkanoates of 2–20 carbon atoms, alcoholates, acetylacetonates, halides and metal oxides. For obvious reasons, it is preferable to use anions already present in the oil, such as palmitate, stearate, oleate, linoleate or linolenate anions, or alternatively anions which can be easily removed, such as octoates.

By reducing agent, is meant an organic derivative having at least one carbon-metal bond of a metal from groups I A,II A, II B and III A or a hydride thereof, for example a sodium, lithium, aluminum or magnesium hydride or organic derivative, preferably triethylaluminum. Other useful compounds include, for example, triisobutylaluminum, diisobutylaluminum hydride, substituted or unsubstituted aluminum hydrides, mixed aluminum and sodium or lithium hydrides and their derivatives, sodium naphthalide, butyl lithium, di-ethyl ethoxy aluminum and mono-ethyl and di-ethyl aluminum carboxylates.

Preferred reducing agents are of the formula $MR_3$, in which M is a metal of group III A, for example aluminum, and the identical or different R radicals are hydrogen and/or hydrocarbyl radicals.

The above metal compounds and reducing agents are well-known to those skilled in the art.

These catalysts may be used in homogeneous phase or carried on conventional supports such as alumina, silica, molecular sieves, active carbon, alumina-silica or chromium oxide.

The oils which can be hydrogenated are diverse, for example, cottonseed oil, soyabean oil, safflower oil, peanut oil, rapeseed oil, sunflower oil, corn oil, linseed oil, palm oil, kapok oil, sesame oil or wheat germ oil.

Mixtures of oils may also be hydrogenated.

The catalysts are particularly useful for selectively hydrogenating oils containing linolenic acid to eliminate this acid.

The catalyst may be manufactured at temperatures of 20°–180° C, preferably 110°–170° C. The most selective catalysts are obtained in the latter range.

The molar ratio of the reducing compound to the metal compound is preferably from 0.5:1 to 4:1.

The hydrogenation may be conducted under various conditions. The hydrogenation temperature may range from 20° to 250° C, for example, from 50° to 200° C. It is preferred to operate at 120–180° C with a low concentration of catalyst (from 20 to 100 ppm by weight of the metal from groups I B, IV B to VII B and VIII, with respect to oil) under these conditions, only a very small amount of stearic ester is formed, which constitutes an unobvious result. The hydrogen pressure is variable from 0.5 to 150 bars, preferably from 2 to 100 bars.

The catalyst concentration may be, for example, from 10 to 1000 ppm, preferably from 10 to 100 ppm as weight of metal/weight of oil. However, when using carriers, the concentration of metal on the carrier may be higher, for example from 1000 ppm to 5% by weight. The process may be conducted batchwise or continuously, or in fixed bed using a supported catalyst.

The oil may have been subjected to various purification treatments. Thus degummed crude oil may be used, or alternatively a neutralized and/or bleached and/or deodorized oil. Frequently, most of these purification treatments are unnecessary.

Finally the catalyst may be manufactured in the reactor itself or separately. The preformed catalyst is usually injected into the reactor containing the oil by means of a device avoiding any poisoning of the oil.

Non-limitative examples of the results obtained with different operating conditions, different metals or pairs of metals and oils purified in different degrees are given hereafter to illustrate the versatility of the catalyst employed according to the invention. The % are by weight.

EXAMPLE I

Two catalysts are prepared by dissolving 945 mg of copper stearate respectively in 100 g of heptane (catalyst 1) and 10 g of refined soyabean oil (catalyst 2). 6 mmol. of hot triethylaluminum, i.e., 0.75 ml, is introduced dropwise under argon into each solution by a 1 milliliter syringe. In the first case, the color turns dark brown. In the second case, a brown-red color develops. A fraction of each catalyst 1 or 2 is taken off and injected into an autoclave containing crude soyabean oil.

The crude oil contains 0.6% of free fatty acid and 100 ppm o phosphorus in the form of phosphatide. Its color is dark yellow. The conditions for catalyst 1 are : 0.1 % copper with respect to oil/10 bars/50° C/4 hours.

The conditions for catalyst 2 are :

0.1% copper with respect to oil/20 bars/175° C/3 hours.

The analysis is conducted by gas phase chromatography after methanolysis to transform glycerides to methyl esters.

The results are given in the following table (composition in % by weight).

| | $C_{16}$[a] | $C_{18:0}$[b] | $C_{18:1}$[c] | $C_{18:2}$[d] | $C_{18:3}$[e] |
|---|---|---|---|---|---|
| starting oil | 11.1 | 4.9 | 24.0 | 52.0 | 8.0 |
| oil with catalyst 1 | 11.6 | 17.0 | 38.6 | 30.4 | 2.4 |
| oil with catalyst 2 | 11.1 | 5.2 | 37.3 | 44.2 | 2.2 |

[a]methyl palmitate
[b]methyl stearate
[c]methyl oloate and isomer
[d]methyl linoleate
[e]methyl linolenate.

This example shows that catalyst 2, which conforms to the invention, is more selective than catalyst 1 prepared in a hydrocarbon.

EXAMPLE 2

The same soyabean oil is hydrogenated by two catalytic systems the first one prepared by addition of 4 equivalents of triethylaluminum to one equivalent of chromium stearate dissolved in heptane (solution 1) and the second one prepared according to the invention without heptane in the presence of soyabean oil. The conditions are the following :

solution 1 : 0.1 % Cr in oil at 30° C, 10 bars, 140 minutes solution 2 : 0.1% Cr in oil at 170° C, 30 bars, 12 hours.

| | $C_{18:0}$ | $C_{18:3}$ |
|---|---|---|
| solution 1 | 35.1 | 1.4 |
| solution 2 | 4.8 | 0.8 |

EXAMPLE 3

Crude soyabean oil is hydrogenated with a manganese stearate catalyst containing 9% of manganese, prepared by dissolution of the salt in refined soyabean oil and injection of triethylaluminum in a ratio of Al to Mn of 4. After 18 hours at 210° C and 30 bars, we obtained (0.1% of metal with respect to oil):

$C_{16}$ = 11.3 %
$C_{18:0}$ = 4.0 %
$C_{18:1}$ = 30.2 %
$C_{18:2}$ = 49.5 %
$C_{18:3}$ = 4 %

The oils treated in examples 3 to 12 have substantially the same glyceride composition as the oil treated in example 1. The resulting oil may be admixed with an equal volume of oil free of $C_{18:3}$ and the resulting mixture is useful as frying oil.

EXAMPLE 4

We have hydrogenated soyabean oil previously subjected to purification by passage through a Florisil column, with a catalyst made from iron stearate dissolved in refined soyabean oil and reacted with triethyl aluminum: Al/Fe ratio = 4. After 5 hours at 190° C, 30 bars with 0.1% Fe/oil, we obtained:

$C_{16}$ = 11.4 %
$C_{18:0}$ = 4.2 %
$C_{18:1}$ = 49.3 %
$C_{18:2}$ = 32.7 %
$C_{18:3}$ = 1.7 %
conjugated dienes = 0.7 %

EXAMPLE 5

The same soyabean oil as in example 4 is hydrogenated with silver palmitate, obtained by reacting palmitic acid with freshly prepared silver oxide. This palmitate is dissolved in refined soyabean oil and triethylaluminum is added thereto in a molar ratio of Al to Ag of 4. A very stable orange-red coloration appears. The hydrogenation is slow. It is carried out at 200°-220° C/30 bars/with a 0.2 % metal to oil ratio.

There is obtained after 18 hours:

$C_{16:0}$ = 11.4 %
$C_{18:0}$ = 4.2 %
$C_{18:1}$ = 41.0 %
$C_{18:2}$ = 38.0 %
$C_{18:3}$ = 1.5 %
conjugated derivatives : 3.9 %

EXAMPLE 6

Gold palmitate is prepared according to the method of the preceding example, and there is obtained under the same conditions, after 24 hours at 210° C and 30 bars:

$C_{16}$ = 11.6 %
$C_{18:0}$ = 4.5 %
$C_{18:1}$ = 34.7 %
$C_{18:2}$ = 45.6 %
$C_{18:3}$ = 3.6 %

EXAMPLE 7

When using a nickel salt, the hydrogenation is very rapid. Crude oil has been hydrogenated with nickel stearate previously dissolved in purified soyabean oil and reduced with 3 equivalents of triethylaluminum. The following results have been obtained with a ratio of 0.025 % of nickel to oil at 125° C and 20 bars for 10 minutes.

$C_{16}$ = 10.8 %
$C_{18:0}$ = 6.6 %
$C_{18:1}$ = 48.2 %
$C_{18:2}$ = 32.7 %
$C_{18:3}$ = 1.7 %

EXAMPLE 8

Another salt of nickel may be used and reduced substantially as described in example 7. The following results have been obtained with 0.1 % of catalyst obtained from bis (pyridine) nickel acetylacetonate. The conditions were 60° C, 30 bars and 45 minutes :

| | | | | | |
|---|---|---|---|---|---|
| $C_{16}$ | = | 11.4% | $C_{18:2}$ | = | 42.4% |
| $C_{18:0}$ | = | 6.2% | $C_{18:3}$ | = | 2.40% |
| $C_{18:1}$ | = | 37.6% | | | |

EXAMPLE 9

Two soyabean oils have been hydrogenated with a copper catalyst, identical to catalyst 2 of example 1, used in a proportion of 0.1 % copper/oil. The results were the following, in % by weight:

| | 1 bar | 2 bars | 5 bars |
|---|---|---|---|
| $C_{16}$ | 10.8 | 10.8 | 10.6 |
| $C_{18:0}$ | 4.4 | 4.8 | 5.0 |
| $C_{18:1}$ | 34.7 | 48.4 | 57.1 |
| $C_{18:2}$ | 45.3 | 34.4 | 26.6 |
| $C_{18:3}$ | 3.6 | 0.9 | traces |

EXAMPLE 11

Crude oil was hydrogenated with a catalyst prepared in purified soyabean oil from a mixture of nickel stearate and copper stearate in a ratio of 1 to 10. The Al/metal ratio was 4. The conditions were :

| 0.05% metal/oil/120° C/20 bars/5 hours | | |
|---|---|---|
| $C_{16}$ | = | 10.8% |
| $C_{18:0}$ | = | 7.4% |
| $C_{18:1}$ | = | 38.3% |
| $C_{18:2}$ | = | 40.3% |
| $C_{18:3}$ | = | 3.1% |
| trans % | = | 10.9 |

EXAMPLE 12

The hydrogenation is conducted, respectively, with two solutions prepared from copper stearate and triethylaluminum according to the embodiment No. 2 of example 1 and a Al/Cu ratio of 4 for solution 1 and 0.4 for solution 2. Purified oil is used.

After 3 hours at 200° C and 30 bars with solution 1, no more $C_{18:3}$ is present, while after 48 hours at 200° C and 30 bars with solution 2, there remains 3.8 % of $C_{18:3}$. The selectivity has remained unaffected.

EXAMPLES 13–17

Several catalysts have been prepared by dissolving nickel stearate and a stearate of an additional metal into the minimum amount of refined soyabean oil to which triethylaluminum has been added in a molar ratio of the aluminum compound to the nickel compound of 3.

These catalysts have been used to hydrogenate a crude soyabean oil of the composition given in example 1, at a pressure of 20 bars. The results are reported in the following table.

| CATALYST (ppm with respect to oil) | T ° C | t min. | %$C_{16}$ | %$C_{18:0}$ | %$C_{18:1}$ | %$C_{18:2}$ | $C_{18:3}$ |
|---|---|---|---|---|---|---|---|
| 50 Ni + 10 Al | 130 | 13 | 11.6 | 6.7 | 54.4 | 26.3 | 0.5 |
| 25 Ni + 5 Zn | 135 | 15 | 11.2 | 7.2 | 45.9 | 34.5 | 0.9 |
| 50 Ni + 10 Mn | 150 | 5 | 11.2 | 5.5 | 53.9 | 27.6 | 1.25 |
| 50 Ni + 10 Ca | 110 | 15 | 10 | 8.7 | 53.8 | 24.9 | 1 |
| 40 Ni + 10 Fe | 150 | 5 | 11.2 | 7.2 | 44 | 34 | 1.8 |

| | Refined oil hydrogenated at 200° C and 30 bars | Crude oil hydrogenated at 200° C and 30 bars |
|---|---|---|
| $C_{16}$ | 10.1% | 10.8% |
| $C_{18:0}$ | 5.4% | 5.1% |
| $C_{18:1}$ | 41.9% | 42.4% |
| $C_{18:2}$ | 40.8% | 40.2% |
| $C_{18:3}$ | 1.8% | 1.5% |

EXAMPLE 10

It is unnecessary to use high pressures. With 0.1 % of catalyst at 220° C, the results obtained with the preceding catalyst and crude oil (% by weight) are the following:

EXAMPLE 18

The Ni + Fe catalyst of example 17 has been used to hydrogenate a refined primor rapeseed oil at 115° C, 20 bars for 30 minutes. The following results have been obtained :

| | % initial oil | % hydrogenated oil |
|---|---|---|
| $C_{16}$ | 4.4 | 4.4 |
| $C_{18:0}$ | 1.5 | 11.7 |
| $C_{18:1}$ | 61.2 | 69.3 |

-continued

| | % initial oil | % hydrogenated oil |
|---|---|---|
| $C_{18:2}$ | 20.4 | 11 |
| $C_{18:3}$ | 9.5 | 0.6 |
| various | 3.0 | 3.0 |

By crude oil, we mean a gum-free oil containing at least 40 ppm of phosphorus by weight, essentially in organic form.

By refined oil, in the above examples, we mean a crude oil which has been subjected to neutralization and bleaching.

What we claim is:

1. In a process for selectively hydrogenating a polyunsaturated glyceridic oil of vegetable or animal origin, wherein hydrogen is reacted with said oil in contact with a catalyst obtained by reacting in a solvent: (a) at least one compound of a metal from groups I B, IV B, V B, VI B, VII B and VIII with (b) at least one reducing organic compound having at least one carbon metal bond or hydride or a metal from groups I A, II A, II B and III A, the molar ratio of the reducing compound to the metal compound being from 0.1 to 1 to 6:1, the improvement wherein said solvent consists essentially of a polyunsaturated glyceridic oil of vegetable or animal origin.

2. A process according to claim 1, wherein the molar ratio of said reducing agent to said metal compound is from 0.5:1 to 4:1.

3. A process according to claim 1, wherein said reducing agent is an organic sodium, lithium, aluminum or magnesium compound.

4. A process according to claim 1, wherein said metal compound is a copper, silver, gold, chromium, iron, nickel, cobalt, molybdenum, tungsten, titanium or manganese compound.

5. A process according to claim 1, wherein said metal compound is a pair of nickel and copper compounds, nickel and silver compounds copper and chromium compounds or nickel and chromium compounds.

6. A process according to claim 1, wherein the catalyst is made by heating at 80°-180° C.

7. A process according to claim 1, wherein the catalyst is obtained from 10 to 100 parts by weight of metal from groups I B, IV B to VII B or VIII per million of parts by weight of oil being hydrogenated.

8. A process according to claim 1, wherein the oil being hydrogenated is a crude oil.

9. A process according to claim 1, wherein the oil being hydrogenated is cottonseed oil, safflower oil, peanut oil, rapeseed oil, sunflower oil, corn oil, linseed oil, palm oil, kapok oil, sesame oil, wheat germ oil or soyabean oil.

10. A process according to claim 9, wherein the oil is soyabean oil or rapeseed oil.

11. A hydrogenated oil, obtained by the process of claim 1.

12. A hydrogenated soyabean oil, obtained by the process of claim 10.

13. A process according to claim 1, wherein (a) is at least one compound of copper, chromium, manganese, iron, silver, gold, or nickel.

14. A compound according to claim 13, wherein said (a) at least one compound of a metal is a carboxylate of 2-20 carbon atoms.

15. A process according to claim 1, wherein said (a) at least one compound of a metal is nickel carboxylate of 2-20 carbon atoms.

16. A process according to claim 13, wherein said (b) at least one reducing organic compound is of the formula $MR_3$ wherein M is a metal of group IIIA, and R, being identical or the same, is hydrogen or hydrocarbyl.

17. A process according to claim 14, wherein said (b) at least one reducing organic compound is of the formula $MR_3$ wherein M is a metal of group IIIA, and R, being identical or the same, is hydrogen or hydrocarbyl.

18. A process according to claim 15, wherein said (b) at least one reducing organic compound is of the formula $MR_3$ wherein M is a metal of group IIIA, and R, being identical or the same, is hydrogen or hydrocarbyl.

19. A process according to claim 16 wherein M is aluminum.

20. A process according to claim 17 wherein M is aluminum.

21. A process according to claim 18 wherein M is aluminum.

22. A process according to claim 21 wherein the oil being hydrogenated is cottonseed oil, safflower oil, peanut oil, rapeseed oil, sunflower oil, corn oil, linseed oil, palm oil, kapok oil, sesame oil, wheat germ oil or soyabean oil.

23. A process according to claim 1 wherein said solvent contains no hydrocarbon oil.

24. A process according to claim 22 wherein said solvent contains no hydrocarbon oil.

* * * * *

UNITED STATES PATENT AND TRADEMARK OFFICE

CERTIFICATE OF CORRECTION

PATENT NO. : 4,038,295

DATED : July 26, 1977

INVENTOR(S) : ROBERT STERN ET AL.

It is certified that error appears in the above-identified patent and that said Letters Patent are hereby corrected as shown below:

Claim 1, column 7, line 22: "hydride or a metal" should read -- hydride of a metal --.

Signed and Sealed this

Ninth Day of May 1978

[SEAL]

Attest:

RUTH C. MASON
Attesting Officer

LUTRELLE F. PARKER
Acting Commissioner of Patents and Trademarks